US005829362A

United States Patent [19]

Evans et al.

[11] Patent Number: 5,829,362

[45] Date of Patent: Nov. 3, 1998

[54] STILLAGE FOR STORING DRUMS

[75] Inventors: Raymond Victor Evans; David Stephen Hayward, both of Warrington, United Kingdom

[73] Assignee: British Nuclear Fuels plc., Warrington, England

[21] Appl. No.: 737,964

[22] PCT Filed: May 25, 1995

[86] PCT No.: PCT/GB95/01197

§ 371 Date: Jan. 13, 1997

§ 102(e) Date: Jan. 13, 1997

[87] PCT Pub. No.: WO95/33268

PCT Pub. Date: Dec. 7, 1995

[30] Foreign Application Priority Data

May 27, 1994 [GB] United Kingdom ..... 9410757

[51] Int. Cl.[6] ..... B65D 19/44

[52] U.S. Cl. ..... 108/55.1; 108/53.1

[58] Field of Search ..... 108/55.1, 55.3, 108/53.1, 57.13, 57.16, 57.32

[56] References Cited

U.S. PATENT DOCUMENTS

| | | | |
|---|---|---|---|
| 3,865,250 | 2/1975 | Jay | 108/53.1 X |
| 4,013,020 | 3/1977 | Schoeller et al. | 108/55.3 X |
| 4,572,372 | 2/1986 | Smith et al. | 206/511 |
| 5,052,307 | 10/1991 | Morrison | 108/53.1 |
| 5,533,456 | 7/1996 | Regina | 108/55.1 X |

FOREIGN PATENT DOCUMENTS

| | | | |
|---|---|---|---|
| 0303264 | 8/1988 | European Pat. Off. . | |
| 2249547 | 10/1974 | France . | |
| 2159650 | 6/1972 | Germany | 108/55.1 |
| 2404390 | 7/1975 | Germany | 108/55.1 |
| 111252 | 5/1991 | Japan | 108/55.1 |
| 883912 | 5/1959 | United Kingdom . | |
| 2112742 | 1/1982 | United Kingdom . | |
| WO84/00343 | 2/1984 | WIPO . | |

*Primary Examiner*—Jose V. Chen
*Attorney, Agent, or Firm*—Sheridan Ross P.C.

[57] ABSTRACT

A fabricated metal stillage for storing and/or transporting a plurality of drums containing hazardous material, such as radioactive waste, comprising a rectangular planar base having a post extending upwardly from each corner. Each post is hollow and is provided with a support pad at an end remote from the base. The support pads lie in a plane substantially parallel to the base. Upper and lower tie plates extend between the four posts to define a perimeter around the stillage. Internal partition plates are provided to form a plurality of compartments for receiving the drums, the inner ends of the partition plates being attached to a central ring. The stillages can be arranged in a free-standing stack with the base of an upper stillage resting on the support pads of a stillage beneath it. Such a stack is able to withstand loads resulting from seismic events.

28 Claims, 6 Drawing Sheets

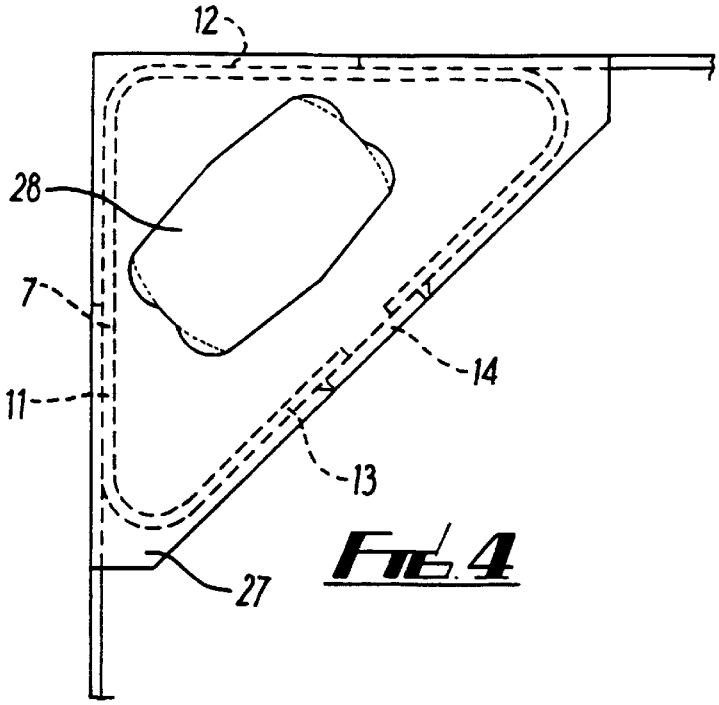
FIG. 4
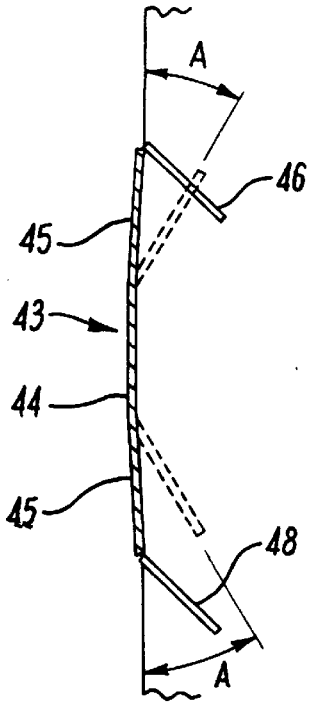
FIG. 5
FIG. 8
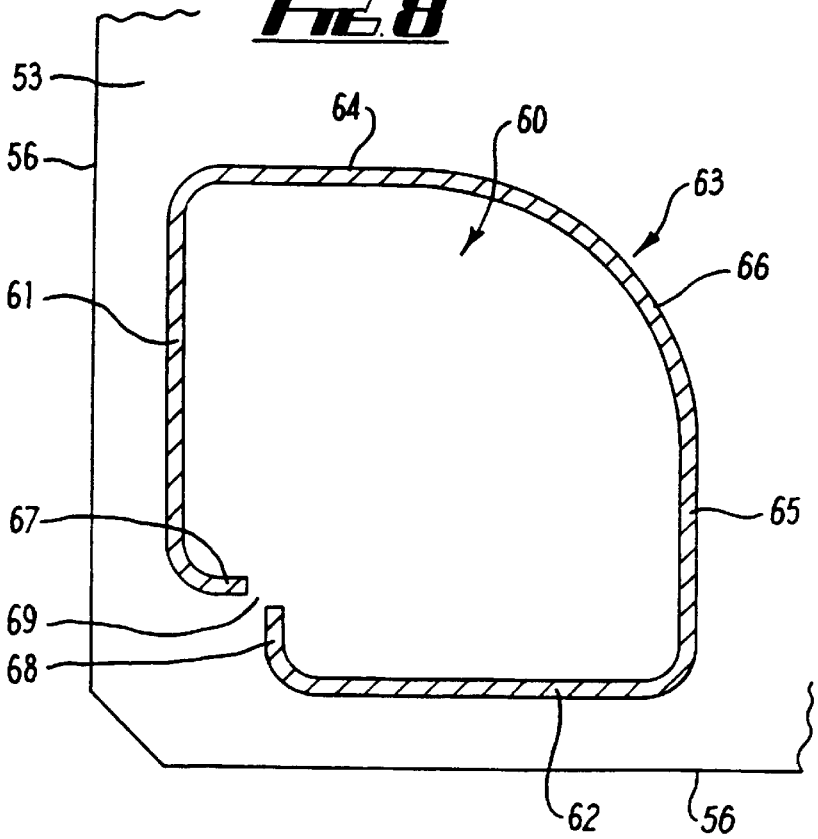

STILLAGE FOR STORING DRUMS

FIELD OF THE INVENTION

This invention relates to the storage of hazardous material and, in particular, to a stillage for storing and/or transporting a plurality of drums containing, for example, radioactive waste.

BACKGROUND OF THE INVENTION

It is known, for example, to store radioactive waste which is encapsulated in a cementitious matrix inside stainless steel drums. The drums are stored within a shielded building, possibly to await eventual disposal in a deep underground repository. The shielded building and the system for storing the drums within the building must be designed to resist not only normal operational loads but also seismic and extreme environmental conditions. Otherwise, such occurrences could initiate the leakage of radioactive substances from the drums, resulting in a dangerously polluted atmosphere.

From French Utility Certificate No. 2249547 it is known to provide a stillage in which four drums containing radioactive waste can be accommodated. The stillages can be arranged one above another to form a vertical stack. However, a problem with the stillage disclosed in this prior publication is that its construction is not conducive to the formation of a stack of, say, more than three stillages that will remain stable during loadings caused by a seismic event. Thus, stacks formed from more than three of these prior art stillages may require support from a separate framework designed to withstand seismic loading. Such a framework is complicated and expensive to manufacture and construct and may require a horizontal restraint linked to the building structure in which the stillage stacks are formed, thereby restricting the utility of the system.

A further disadvantage of such a prior art system is that the stillage support framework occupies a substantial amount of space. Therefore, the number of stillages, and hence the number of drums, that can be stored in the building is limited. Difficulties are also encountered in that the stillage support framework impedes the desired circulation of cooling air around the drums. If a horizontal restraint is provided between the stillage support framework and the storage building walls, any occurrence of seismic loadings will be transmitted through the restraint to the walls. Consequently, the walls will need to be thick, so adding to the costs incurred in constructing the building.

It is an object of this invention to provide a stillage for storing and/or transporting a plurality of drums containing hazardous material which overcomes, or at least minimises, the above-mentioned disadvantages.

According to the present invention a stillage for storing and/or transporting a plurality of drums containing hazardous material comprises a fabricated metal structure comprising a substantially planar base having four sides defining a substantially rectangular shape, a post provided at each corner of the base, each post extending upwardly from and perpendicularly to the base, and a plurality of support pads, each of which is provided on or fixed to a post at an end remote from the base and disposed so as to lie in a plane parallel to, or substantially parallel to, a plane containing the base.

Preferably, each post comprises a hollow structure having two planar outer walls, each of which extends parallel to, or substantially parallel to, an adjacent side of the base.

Each post may have an inner wall extending between two mutually remote ends of the two planar outer walls to define a hollow structure of triangular cross-section. Alternatively, the inner wall extending between the two mutually remote ends of the outer wall comprises a first planar section extending inwardly from one of the remote ends, a second planar section extending inwardly from the other of the remote ends, and an arcuate portion extending between and interconnecting the first and second planar sections.

Desirably, each support pad has sides extending parallel to, or substantially to, the walls of an associated post. Thus, for example, where the posts are of triangular cross-section, the support pads may be triangular with a greater cross sectional area than the posts.

The stillage preferably comprises a plurality of tie plates arranged so as to define a perimeter around the stillage, each tie plate extending between and fixed to two adjacent posts. Each tie plate may be fixed to two co-planar outer walls of two adjacent posts. Thus, the inner surfaces of the tie plates may be substantially coplanar with the outer surfaces of the posts to which they are attached, thereby facilitating fixing by a known method, such as, welding.

The tie plates may comprise four upper tie plates, each upper tie plate extending between two adjacent posts at a position above the base.

Preferably, the upper tie plates have a substantial depth and each tie plate may have dimensions such that the length thereof is of the order of 4 to 8 times greater than the vertical dimension.

The tie plates may further comprise four lower tie plates, each lower tie plate extending between two adjacent posts, at a position below said upper tie plates so as to define a perimeter around the stillage at a lower region thereof. Each lower tie plate may have a lower side with a portion at each end thereof extending from a respective post in a downwardly inclined direction, the portion defining with the base and the post an aperture communicating with the interior of the stillage. Each lower tie plate may have an upper side extending at each end thereof from a respective post in a downwardly inclined direction. Alternatively, the upper side of each lower tie plate may extend parallel to a plane containing the base.

Preferably, the stillage has a plurality of internal compartments for receiving the drums, the compartments being formed by internal partition plates, each of which has an outer end connected to a lower tie plate and extending inwardly therefrom.

In a preferred embodiment of the invention a ring is provided centrally within the stillage and positioned above the base, the inner ends of each of the internal partition plates being attached to the ring. An opening is preferably provided in the base at a position co-axial with the ring. Thus, when the stillages are arranged as a vertical stack the rings and holes provide a central passage through the stack, enabling monitoring equipment, such as a camera, to be moved between the drums.

The stillage of the present invention has several features which provide benefits not afforded by the stillage described in French Utility Certificate No. 2249547. For example, in the prior art stillage, there is little margin for stacking error when placing one stillage on top of another, because of the narrow width of the bearing face on the top cross-rails. This feature also leads to the disadvantage that very little side slip, which may result from a seismic event, can be tolerated. Thus, a stack of prior art stillages would be unstable and unable to withstand the effects of a seismic event. In contrast, the stillage of the present invention is provided with support pads fixed to the upper ends of the posts to serve as bearing surfaces. When formed into a stack, the base of one stillage rests on the support pads of the stillage below, thus providing adequate support in the maximum lateral or diagonal side slip conditions experienced in a design base earthquake.

Furthermore, when forming a stack of prior art stillages, care must be taken to ensure that each stillage is orientated correctly, otherwise a tall side could be placed above a short side of the stillage beneath. Again this would result in an unstable stack. In the stillage of the present invention, however, the design is totally symmetrical and enables stacking in any orientation without disadvantage.

The prior art stillage is constructed from relatively thick side rails and internal partitions in contrast to the stillage of the present invention in which the corresponding components are made from relatively thin plates. Thus, for a given drum diameter, the stillage of this invention has a smaller overall width, enabling more stacks to be accommodated in a given storage area. Furthermore, the prior art stillage is constructed from rigid, hollow section beams which are likely to be dented or breached if a drum impacts against them in, say, a seismic event and could be permanently dented. The tie plates and internal partitions of the present invention are made from deep, but thin plates which will cushion the drums in a sideways impact and recover their original shape. Construction from low-weight thin sections also contributes to advantages regarding costs, stacking weight, handling equipment and ultimate disposal.

The stillage described in French Utility Certificate No. 2249547 is designed for handling by a fork lift truck in that bars are fixed to the underside of the base so that it is raised from the floor to provide clearance for insertion of the prongs of the fork lift truck. Also, when the stillages are formed into a stack, sufficient space must be allowed for the fork lift truck prongs between the upper surfaces of the drums and the base of a stillage mounted above. This is wasteful of valuable store headroom. In contrast, the base of the stillage of the present invention is the lowest part of the stillage, and this feature, in addition to the minimal clearance from the tops of the drums to the tops of the stillage posts, provides minimum vertical pitch and optimum use of store height. This is possible because stillage handling by a fork lift truck is not used, since this method of handling is not suitable for use in radioactive areas. The present stillages are designed to be lifted from above by a four-pin grapple which can be operated remotely or manually, as necessary.

BRIEF DESCRIPTION OF THE DRAWINGS

Embodiments of the invention will now be described, by way of example, with reference to the accompanying drawings, in which:

FIG. 4 is a plan view of a supporting post for the stillage viewed on arrow A in FIG. 1;

FIG. 5 shows a detail of the stillage viewed on the line V—V in FIG. 1;

FIG. 8 is a sectional plan view of a post taken on the line VIII—VIII in FIG. 6 at an enlarged scale;

DETAILED DESCRIPTION OF THE PREFERRED EMBODIMENTS

The stillages according to the present invention may be used for the stacking or transport of containers, especially drums containing hazardous waste, such as radioactive intermediate level waste material.

Figure 1:
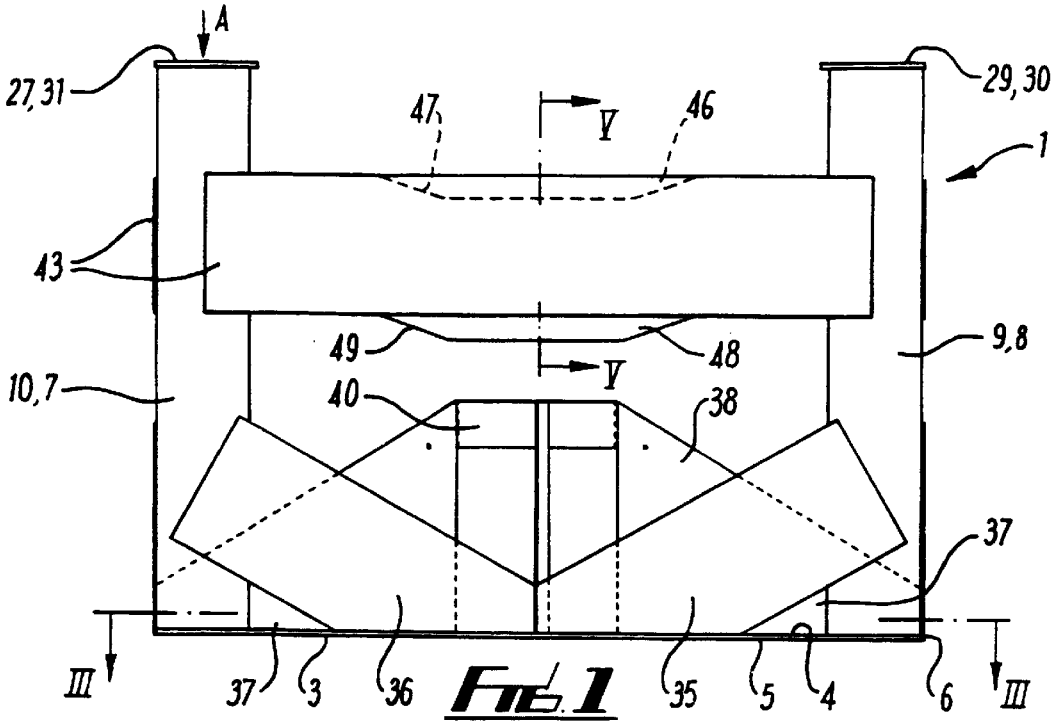
FIG. 1 is a side elevation of a stillage for storing drums according to a preferred embodiment of the invention
Figure 2:
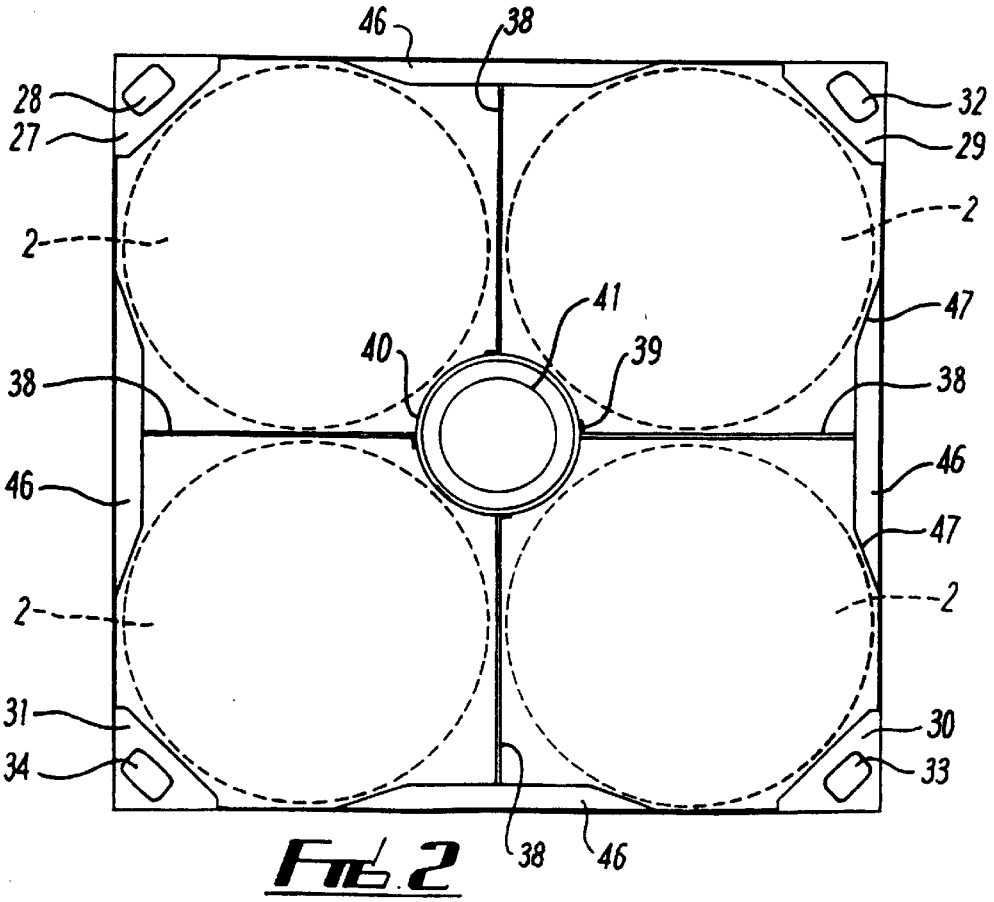
FIG. 2 is a plan view of the stillage shown in FIG. 1.

Referring to FIGS. 1 and 2, a stillage 1 is shown for storing four cylindrical drums 2, indicated in dotted lines in FIG. 2, which contain hazardous material, for example, encapsulated radioactive waste. The shape of the drums need not be cylindrical and could, for example, be square. The stillage 1 is fabricated from steel plate which may comprise, for example, a high chrome ferritic steel. The stillage comprises a rectangular base 3 in the form of a flat square plate having an upper surface 4, a lower surface 5 and four sides 6. Typically, the base 3 may have a thickness of 6.5 mm. Extending upwardly and perpendicularly from the base 3 and welded to the upper surface 4 at each corner thereof are four supporting posts 7, 8, 9, 10.

Figure 3:
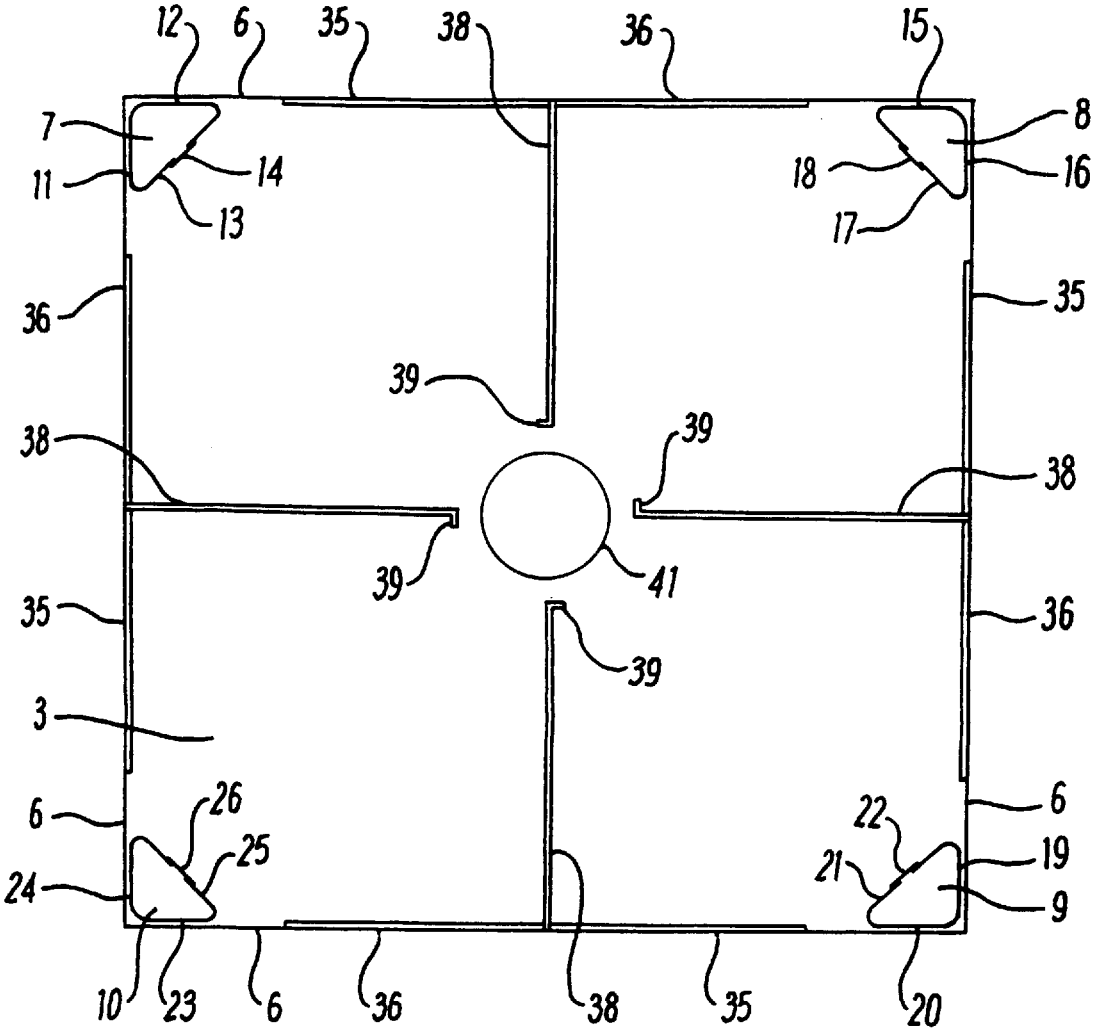
FIG. 3 is a sectional plan view of the stillage taken on the line III—III in FIG. 1.

As best seen in FIGS. 3 and 4, each post is a hollow, flat-sided structure of triangular cross section and formed by bending a single plate. The post 7 has two outer planar walls 11, 12, each lying in a plane parallel to an adjacent side 6 of the base 3. Each of the outer walls 11, 12 is bent inwardly to form an inner wall 13, each inwardly bent portion forming an angle of 45° with respect to an adjacent outer wall 11, 12. An elongate strip 14 is welded to the inside of the post 7 to cover a gap formed centrally along the inner wall 13. The strip does not extend right to the base 3 so as to leave a gap which, if desired, allows grout to flow into the post.

Each of the other posts 8, 9, 10 is formed in a similar manner. Thus, the post 8 has two outer walls 15, 16 and an inner wall 17 provided with a central strip 18. The post 9 has two outer walls 19, 20 and an inner wall 21 provided with a central strip 22 and the post 10 has two outer walls 23, 24 and an inner wall 25 having a central strip 26.

Welded to the upper end of each post 7, 8, 9, 10 is a flat support pad of a generally triangular shape which substantially conforms to the cross-sectional shape of the posts. As seen in FIG. 4, a support pad 27 is welded to the upper end of the post 7, the support pad being arranged so that its sides are parallel to the walls 11, 12, 13 of the post. The dimensions of the support pad 27 are such that the cross-sectional area is greater than that of the post 7 so that its sides overhang the walls 11, 12, 13 by a slight amount. A factor taken into account in determining the size of the support pads is the allowable extent of lateral slippage in a stack when subjected to a seismic event. A slot 28 is provided in the support pad 27 to facilitate the insertion of a grapple attached to a crane used for handling the stillage. Similarly, triangular-shaped support pads 29, 30, 31 are welded to the upper ends of the respective posts 8, 9, 10, each support pad being provided with stillage handling slots 32, 33, 34, respectively. The four grapple handling slots 28, 32, 33, 34 are accurately spaced relative to one another so that repeated handling by the crane is facilitated. All of the support pads 27, 29, 30, 31 lie in a plane which is parallel to a plane containing the base 3. The strips 14, 18, 22, 26 do not extend right to the base 3, or to the support pads 27, 29, 30, 31, so as to leave gaps through which, if desired, grout can flow into the posts. These strips also serve to guide the drums into and out of the stillage and will prevent the top of a drum from catching under a pad during removal of a drum.

At the lower region of the stillage 1, lower tie plates are provided between the outer surfaces of the posts to provide the required stiffness characteristics and an outer boundary for the drums 2. As viewed in FIG. 1, the lower tie plates comprise a pair of tie plates 35, 36 each of which has upper and lower sides downwardly inclined from a respective post so that the upper sides converge at a mid-point between the posts 9, 10. At one end the inclined plate 35 is welded to the outer surface 20 of the post 9 so that its lower side is at an angle of 30° with respect to the base 3. Similarly, the inclined plate 36 is welded to the outer surface 23 of the post 10, its lower side forming an angle of 30° with the base 3. Triangular-shaped openings 37 are thereby formed between the posts 9, 10, the plates 35, 36 and the base 3. An advantage provided by these openings 37 is that they improve the flow of cooling air around the drums and they also assist in reducing the possible formation of 'pockets' in which moisture could be trapped during grouting. Lower tie plates 35, 36 disposed as seen in FIG. 1, are also provided between each of the posts 10 and 7, 7 and 8, and 8 and 9.

The adjacent ends of the lower tie plates are shaped so that a lower edge is welded to the upper surface 4 of the base 3. A further edge at each adjacent end of the lower tie plates 35, 36 extends at right angles with respect to the base and is welded to the outer end of an internal partition 38. There are four internal partitions 38 arranged at right angles to the lower tie plates 35, 36 and extending from a central region thereof so as to provide four compartments, each of which will accommodate a waste-containing drum 2. The inner end of each internal partition 38 is formed into a tab 39 which is welded to a band formed into a ring 40 arranged centrally in the stillage and coaxially above a circular hole 41 provided in the base 3. If desired, the ring 40 could be replaced by a component of different shape and the band could, for example, be formed into a square or hexagon. When the stillages are arranged as a vertical stack, the rings 40 and holes 41 provide a central passage through the stack, enabling monitoring equipment, such as a camera, to be moved between the drums 2. Additionally, the central ring 40 serves to counteract any tendency of the base 3 to sag at its centre under the weight of the drums 2, and the hole 41 facilitates the flow of cooling air around the drums. The drums are preferably provided with an annular ring at or adjacent to the largest diameter of the base, thus concentrating the loading close to the stillage sides and internal partitions. Thus, sagging of the base under the weight of the drums is further minimised, enabling the thickness of the base to be kept to a minimum.

Further rigidity is provided for the stillage by a series of upper tie plates 43 welded to and extending between each of the posts. Thus, an upper tie plate 43 extends between and is welded to the outer surfaces 20, 23 of adjacent posts 9, 10 respectively. Similarly, an upper tie plate 43 extends between and is welded at its ends to the two outer surfaces 24, 11 of the two posts 10, 7 respectively, an upper tie plate 43 extends between and is welded at its ends to the two outer surfaces 12, 15 of the posts 7, 8 respectively, and an upper tie plate 43 extends between and is welded at its ends to the outer surfaces 16, 19 of the posts 8, 9 respectively. Thus, the inner surface of each upper tie plate 43 is substantially coplanar with the outer surfaces of the posts to which they are welded. As seen in FIG. 5, each upper tie plate 43 has a slightly bowed formation, having a raised flat central portion 44 and two inclined side portions 45. The bowed shape may be achieved by first forming the two side portions 45 so that angle A is 30°, as shown in dotted lines. The plate is then rolled flat to produce the desired profile. Advantageously, each upper tie plate 43 has a relatively large vertical dimension to provide a substantial surface area. Typically, the length of each upper tie plate may be of the order of 4 to 8 times greater than the vertical dimension.

Welded to the upper side of each of the upper tie plates 43 is a locating plate 46 which extends downwardly and inwardly into the stillage. The locating plate 46 has inclined ends 47 (see FIG. 2) which serve as locating surfaces for the drums 2. A similar locating plate 48 is welded to the lower side of each of the tie. plates 43. The locating plate 48 extends downwardly and inwardly and has inclined ends 49 serving as drum locating surfaces.

Figure 6:
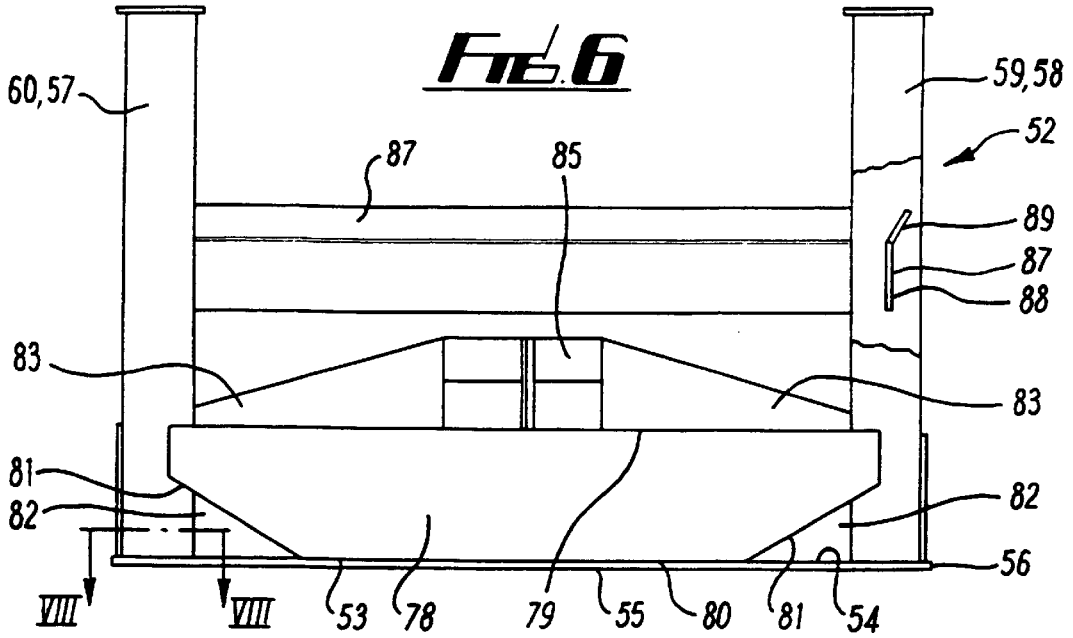
FIG. 6 is a side elevation of a stillage according to a further aspect of the invention.
Figure 7:
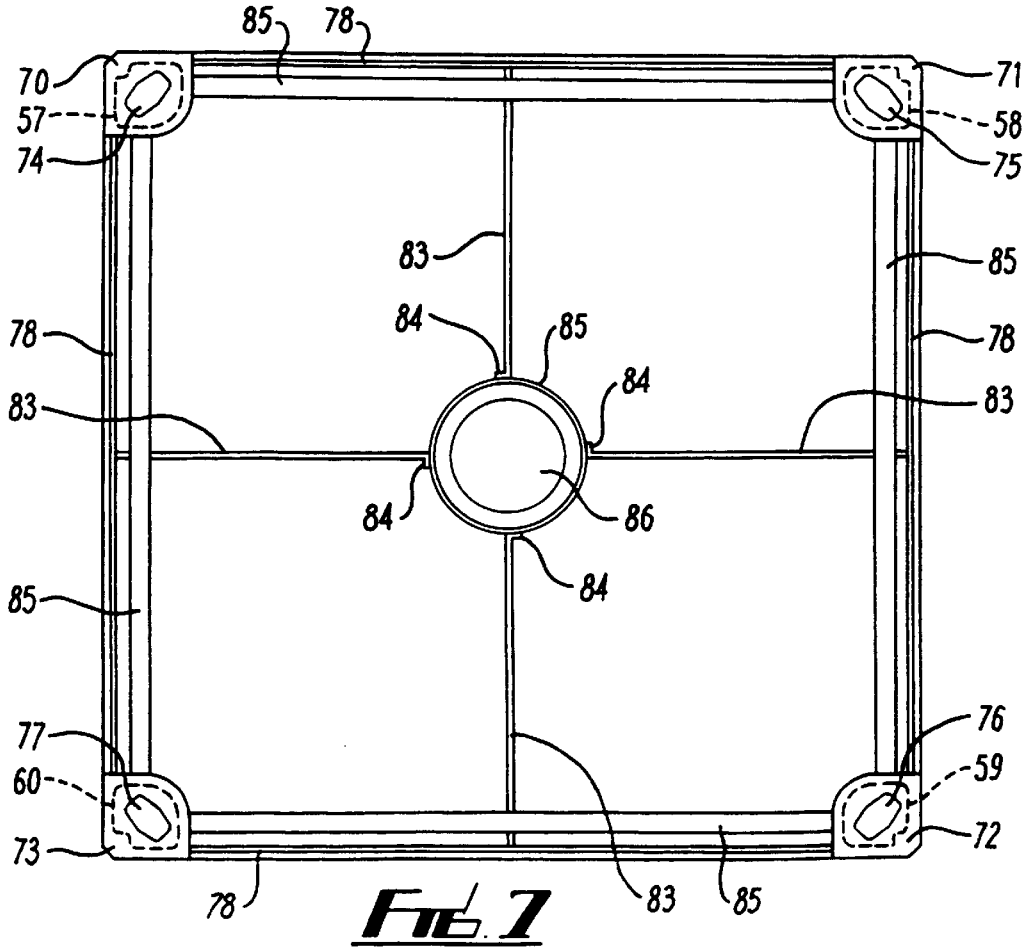
FIG. 7 is a plan view of the stillage shown in FIG. 6.

A further embodiment of the stillage is shown in FIGS. 6, 7 and 8. A stillage 52, of a generally similar design to that described above, has four internal compartments, each of which can accommodate a waste-containing drum. The stillage 52 comprises a square base 53 in the form of a flat plate having an upper surface 54, a lower surface 55 and four sides 56. Extending upwardly and perpendicularly from the base 53 and welded to the upper surface 54 at each corner thereof are four supporting posts 57, 58, 59, 60.

Referring to FIG. 8, a section through the post 60 is shown to illustrate a typical cross-section of the posts. Each post is formed by bending a single plate into a hollow structure having two planar outer walls 61, 62, each lying in a plane parallel to an adjacent side 56 of the base 53. At their two mutually remote ends, the two outer walls 61, 62 are interconnected by an inner wall 63. The inner wall 63 is formed by a short planar section 64 extending inwardly at right angles from the outer wall 61 and by a short planar section 65 extending inwardly at right angles from the other outer wall 62. An arcuate portion 66 interconnects the two short planar sections 64, 65. At their adjacent ends, the two outer walls 61, 62 are bent inwardly to form, respectively, two lip portions 67, 68. A gap 69, extending along the length of the post 60, is formed between the ends of the two lip portions 67, 68. In use, the gap 69 will allow grout to flow into the post, if desired.

Welded to the upper ends of the posts 57, 58, 59, 60 are, respectively, support pads 70, 71, 72, 73 which lie in a plane parallel to a plane containing the base 53. Each of the support pads has a shape which generally conforms to the cross-sectional shape of the post. Thus, the sides of each support pad are generally parallel to an adjacent wall of the associated leg. The dimensions of the support pads are such that the cross-sectional area of each pad is greater than that of the associated post. To facilitate handling of the stillage by a crane, slots 74, 75, 76, 77 are provided, respectively, in the support pads 70, 71, 72, 73 for the insertion of a grapple attached to the crane.

At the lower region of the stillage 52, lower tie plates 78 are provided between the outer surfaces of adjacent posts to provide the stiffness characteristics required by the stillage. Each tie plate 78 is welded to the outer surfaces of two co-planar outer walls of two adjacent posts. The tie plates each have an upper side 79, extending parallel to the base 53, and a lower side 80, extending along the upper surface 54 of the base 53. At each end of the tie plate 78, the lower side 80 has an inclined portion 81 forming an angle of 30° with the base 53. Two triangular-shaped openings 82 are thereby formed adjacent the foot on either side of each of the posts. These openings 82 allow cooling air to circulate around the drums and also reduce the possibility of forming 'pockets' in which moisture could be trapped during grouting.

Extending inwardly from the centre of each of the lower tie plates 78 is an internal partition 83 so as to define four internal compartments in which the waste-containing drums are accommodated. The inner end of each partition 83 is bent to form a tab 84 which is welded to a band formed into a ring 85 arranged coaxially above a hole 86 formed at the centre of the base 54. The ring 85 and the hole 86 serve similar functions and provide the same advantages as the corresponding ring 40 and the hole 41 of the embodiment hereinbefore described.

Rigidity of the stillage is further enhanced by the provision of upper tie plates 87 which extend between each of the posts 57, 58, 59, 60 so as to form a perimeter around the stillage. Each upper tie plate 87 has a lower vertical section 88 and an outwardly inclined upper section 89. The ends of the upper tie plates 87 are welded to the short planar sections 64, 65 forming part of the inner walls 63 of the legs 57, 58, 59, 60. Each of the upper tie plates has a relatively large vertical dimension so as to provide a substantial surface area. The length of each upper tie plate 87 may be of the order of 4 to 8 times greater than the vertical dimension.

Figure 9:
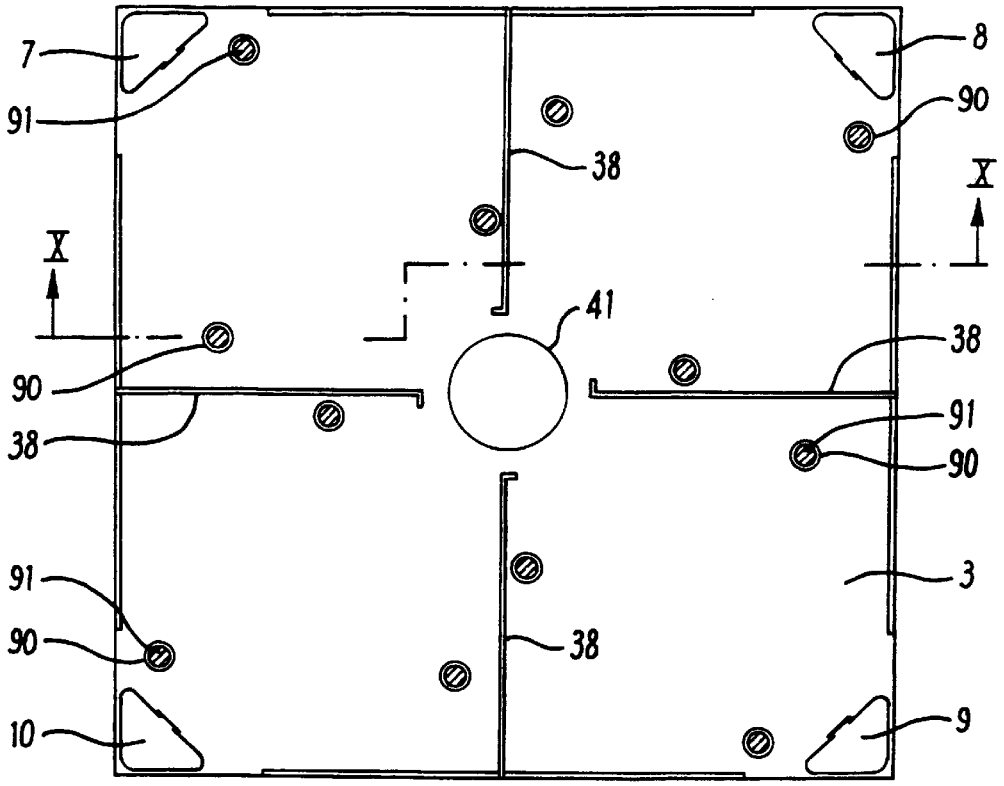
FIG. 9 is a sectional plan view of a modification of the stillage shown in FIG. 1 taken on the line IX—IX in FIG. 10.
Figure 10:
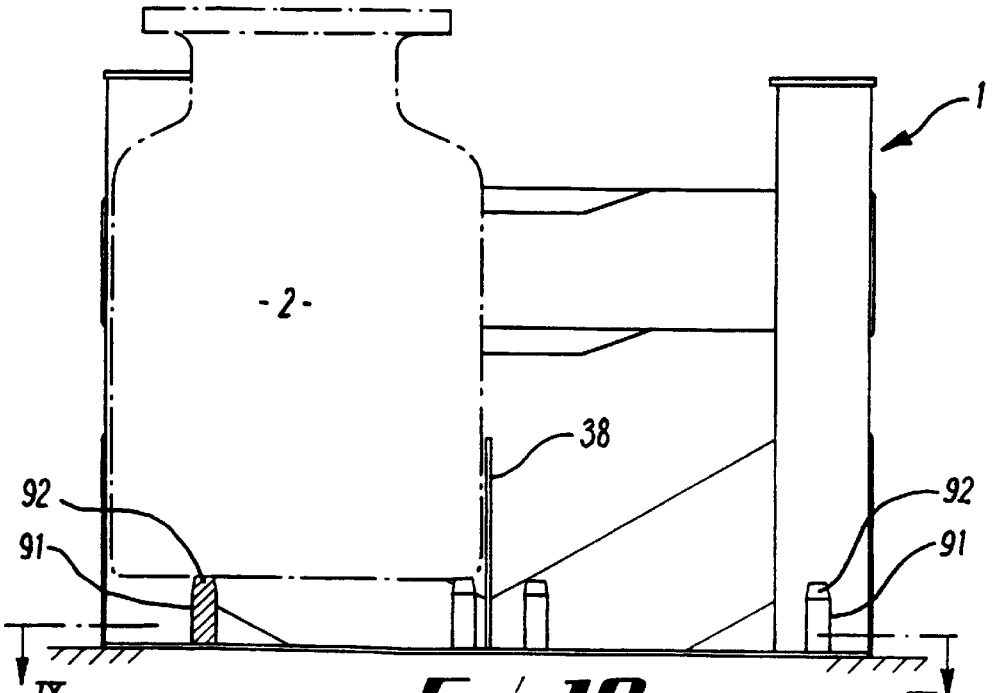
FIG. 10 is a sectional side elevation of the stillage shown in FIG. 9 taken on the line X—X in FIG. 9.

In a modification of the stillage, as shown in FIG. 9, three equi-spaced holes 90 are formed in the base 3 at each of the four compartments. Alternatively, four holes 90 may be provided in each compartment. As seen in FIG. 10, the holes 90 cooperate at a drum loading position with pins 91 located in the floor at a spacing which corresponds with that of the holes 90. The holes 90 are slightly larger in diameter than the pins 91 so that when the stillage 1 is placed at the drum loading position the pins 91 project through the holes 90. To assist passage of the pins 91 through the holes 90, each pin has a tapered position 92 at the upper end. When a drum 2 is placed by a grapple (not shown) in the stillage 1, as shown in FIG. 10, the base of the drum 2 rests on the upper surfaces of the pins 91. The top of the drum 2 projects above the tops of the posts 7, 8, 9, 10 enabling the grapple to be released from the drum without hindrance by the stillage 1. After placing four drums 2 in the stillage 1, grapples engaging the four posts 7, 8, 9, 10 are used to lift the stillage off the floor whereupon the bases of the drums 2 are supported by the base 3 and the tops of the drums are below the tops of the posts.

An advantage of the stillage constructions described above is the formation of the posts with a hollow cross-section, thereby ensuring that the posts possess the optimum compressive strength characteristics, while occupying a relatively small area of the base. This feature, together with the fact that the upper and lower tie plates are made of a relatively thin plate, results in a minimum amount of material surrounding the drums. This enables the dimensions of the base to be kept to a minimum, thus contributing to a stillage of a very compact structure, yet possessing the stiffness characteristics required for satisfactory seismic performance. Such a compact structure enables a maximum number of stillages to be stacked in a given area. A benefit obtained from the relatively large vertical dimensions of the upper and lower tie plates and the internal partitions provides these components with a significant amount of surface area, ensuring that the drums are adequately protected from side impacts.

Figure 11:
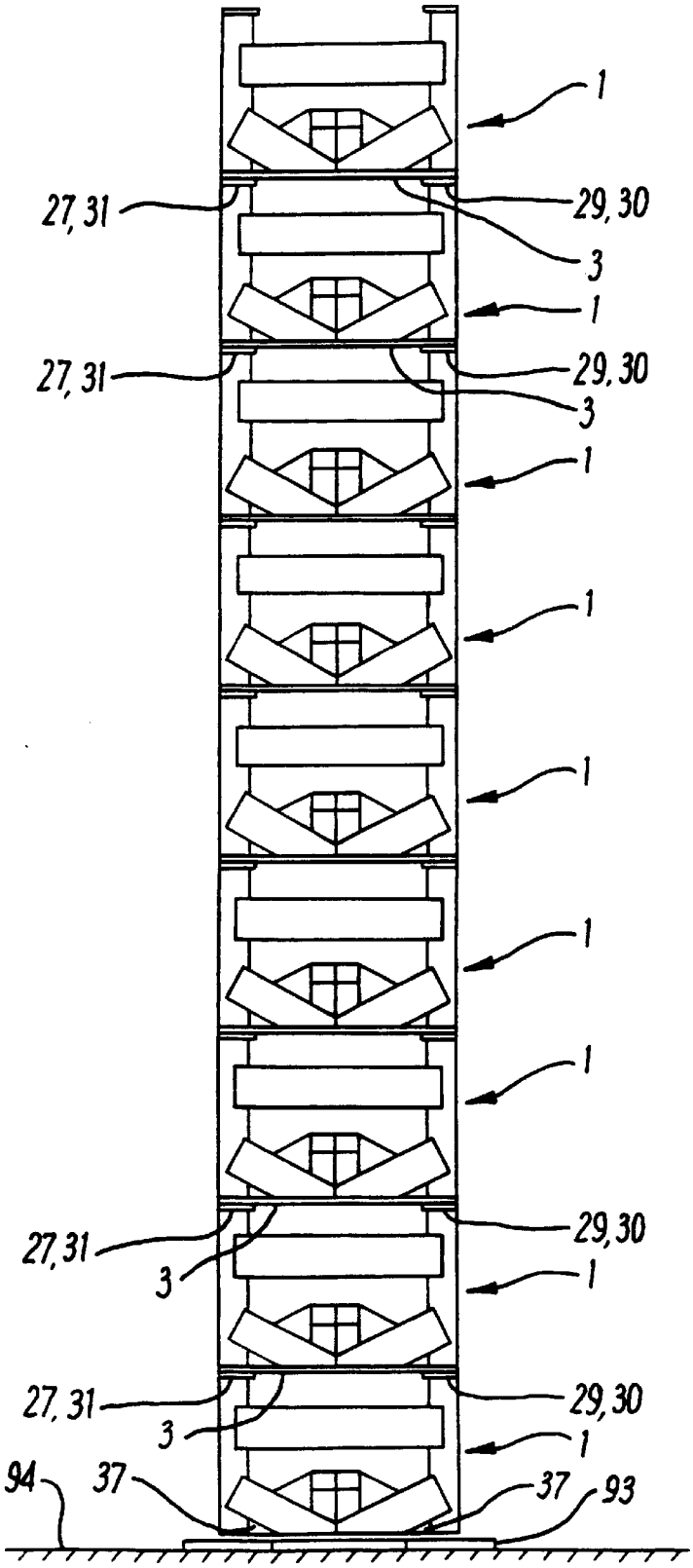
FIG. 11 shows a plurality of the stillages arranged in a vertical stack.

In use, as seen in FIG. 11, the stillages 1, or, alternatively, the stillages 52, each containing four drums 2, are arranged one above the other to form a vertical stack supported on a four floor plates 93 incorporated in the floor 94 of the storage facility. The floor plates 90 are located below each corner of the bottom stillage base 3 and ensure a sound and level foundation for each stack. The base 3 of an upper stillage simply rests on the four support pads 27, 29, 30, 31 of the stillage beneath it. Thus, the stillages in the stack are free to move relative to the floor 94 and to each other. During a seismic event this enables the stillages to slide on each other which dissipates some of the energy generated. Full scale tests have demonstrated that the amount of sliding in a specified seismic event (Design Base Earthquake) will be limited so that the stack will remain standing. Because of the large amount of contact area between the planar base of a stillage and the support pads of the stillage beneath a substantial degree of sliding movement of the stillages in the lateral direction is possible. Since the stack is stable without a separate supporting framework connected to the storage building walls, seismic loads are not transmitted to these walls. Consequently, the walls require less strength to meet a 0.25 g seismic load specification. A stack of nine stillages, each containing four drums, has been found to remain stable during tri-axial seismic evaluation tests.

When arranged within the storage building the stacks can be arranged in rows with a spacing of, for example, 125 mm to 130 mm between the stacks. This facilitates a satisfactory circulation of cooling air around the stillages and the open structure of the stillages enables the cooling air to circulate directly around the drums 2.

If the storage building is a repository in which the spaces in and between the stillages and stacks are grouted to the floor, the openings 37 allow ingress of the grout into the stillages at the bottom of the stacks.

While various embodiments of the present invention have been described in detail, it is apparent that modifications and adaptations of those embodiments will occur to those skilled in the art. It is to be expressly understood, however, that such modifications and adaptations are within the scope of the present invention as set forth in the following claims.

What is claimed is:

1. A stillage for storing and/or transporting a plurality of drums containing hazardous material comprising:

a fabricated metal structure comprising a base having a substantially planar lower surface, and having a plurality of corners defining a predetermined shape of said lower surface;

a post fixedly attached to said base at each of a plurality of said corners, each said post extending upwardly from and perpendicularly to the base; and a plurality of support pads, each of which is attached to an associated one of said posts at an end remote from the base said support pads each having an upper planar surface substantially coincident with a predetermined plane that is parallel to said lower surface;

wherein for at least a first stillage and a second stillage that are stacked so that a first said lower surface of said first stillage is supported by said plurality of support pads of said second stillage, there is sufficient unencumbered area for contact between said first lower surface and said upper planar surface of at least one of said support pads of said second stillage so as to permit lateral movement between said first and second stillages.

2. A stillage according to claim 1, wherein each post comprises a hollow structure having two planar outer walls, each of which extends parallel to, or substantially parallel to, an adjacent aide of the base.

3. A stillage according to claim 2, wherein each post has an inner wall extending between two mutually remote ends of the two planar outer walls to define a hollow structure of triangular cross-section.

4. A stillage according to claim 1, wherein each support pad has sides extending parallel to, or substantially parallel to, the walls of the associated post.

5. A stillage according to claim 2, wherein an inner wall, extending between two mutually remote ends of the two planar outer walls, comprises:

a first planar section extending inwardly from one of said remote ends;

a second planar section extending inwardly from the other of said remote ends; and an arcuate portion extending between and interconnecting said first and second planar sections.

6. A stillage according to claim 1, wherein the stillage further comprises a plurality of tie plates arranged so as to define a perimeter around the stillage, each tie plate extending between and being fixed to: (a) one of said posts, and (b) one of: a different one of said posts and said base.

7. A stillage according to claim 1, wherein each tie plate is fixed to two coplanar outer walls of two adjacent posts.

8. A stillage according to claim 1, wherein the tie plates comprise four upper tie plates, each upper tie plate extending between two adjacent posts at a position spaced above the base.

9. A stillage according to claim 8, wherein the dimensions of each upper tie plate are such that the length thereof is of the order of 4 to 8 times greater than the vertical dimension.

10. A stillage according to claim 8, wherein the tie plates further comprise four lower tie plates, each lower tie plate extending between two adjacent posts at a position below said upper tie plates so as to define a perimeter around the stillage at a lower region thereof.

11. A stillage according to claim 10, wherein each lower tie plate has a downwardly facing side having a portion extending from a corresponding one of said posts in a downwardly inclined direction between said corresponding post and said base, said portion defining with the base and the post an aperture open to an interior of said perimeter of the stillage.

12. A stillage according to claim 10, wherein each lower tie plate has an upper side, each upper side extending at each end thereof from a respective post in a downwardly inclined direction.

13. A stillage according to claim 10, wherein each lower tie plate has an upper side extending parallel to said planar lower surface of the base.

14. A stillage according to claim 10, wherein internal partition plates are provided to form a plurality of internal compartments for receiving the drums, each internal partition plate having an outer end connected to a lower tie plate and extending inwardly therefrom.

15. A stillage according to claim 14, wherein a ring is provided centrally within the stillage and positioned above the base, each internal partition plate having an inner end attached to said ring.

16. A stillage according to claim 15, wherein an opening is provided in the base at a position coaxial with the ring.

17. A stillage according to claim 14, wherein said partition plates comprise thin sheets of substantially flat sheet metal.

18. A stillage according to claim 10, wherein said lower tie plates comprises thin sheets of substantially flat sheet metal.

19. A stillage according to claim 1, wherein said base comprises a substantially flat sheet of metal.

20. A stillage according to claim 1, wherein each of said support pads are provided with apertures into which, grapples are capable of being inserted for lifting said stillage.

21. A stillage according to claim 1, wherein the shape of said support pads substantially conforms to the cross-sectional shape of said corner posts.

22. A stillage for storing and/or transporting a plurality of drums containing hazardous material comprising:

a fabricated metal structure comprising a substantially planar base having four sides defining a substantially rectangular shape;

a post provided at each corner of the base, each said post extending upwardly from and perpendicular to the base; and a plurality of support pads, each of which is provided on or fixed to a post at an end remote from the base and disposed so as to lie in a plane parallel to, or substantially parallel to, a plane containing the base, characterized in that said support pads are flat, and in use, permit mutual lateral movement between at least two stillages stacked together; and a plurality of tie plates arranged so as to define a perimeter of the stillage, each tie plate extending between and being fixed to: (a) one of said posts, and (b) and one of: a different one of said posts and said base, wherein said tie plates include four upper tie plates, each upper tie plate extending between two adjacent posts at a position spaced above the base, and said plurality of tie plates further including four lower tie plates, each lower tie plate extending between two adjacent posts at a position below said upper tie plate so as to define a perimeter around the stillage at a lower region thereof; and wherein each said lower tie plate has a downwardly facing side having a portion extending from a corresponding one of said posts in a downwardly inclined direction between said corresponding post and said base, said portion defining with the base and the post an aperture open to an interior of said perimeter of the stillage.

23. A stillage for storing and/or transporting a plurality of drums containing hazardous material comprising:

a fabricated metal structure comprising a substantially planar base having four sides defining a substantially rectangular shape;

a post provided at each corner of the base, each said post extending upwardly from and perpendicularly to the base; and a plurality of support pads, each of which is provided on or fixed to one of said posts at an end remote from the base and disposed so as to lie in a plane parallel to, or substantially parallel to, a plane containing the base, characterized in that support pads are flat and, in use, permit mutual lateral movement between at least two stillages stacked together;

wherein each of said support pads are provided with apertures into which grapples are capable of being inserted for lifting said stillage.

24. A stillage for storing and/or transporting a plurality of drums containing hazardous material comprising:

a fabricated metal structure comprising:

a substantially planar base having four sides defining a substantially rectangular shape;

a post provided at each corner of the base, each said post extending upwardly from and perpendicularly to the base; and a plurality of support pads, each of which is provided on or fixed to one of said posts at an end remote from the base and disposed so as to lie in plane parallel to, or substantially parallel to, a plane containing the base, characterized in that said support pads are flat, and, in use, permit mutual lateral movement between at least two stillages stacked together;

a plurality of tie plates arranged so as to define a perimeter around the stillage, each tie plate extending between and being fixed to two adjacent posts;

wherein said tie plates include four upper tie plates, each upper tie plate extending between two adjacent posts at a position spaced above the base, and said tie plates further including four lower tie plates, each said lower tie plate extending between two adjacent posts at a position below said upper tie plate so as to define a perimeter about the stillage at a lower region thereof; and internal partition plates forming a plurality of internal compartments for receiving the drums, each internal partition plate having an outer end connected to a lower tie plate and extending inwardly therefrom.

25. A stillage according to claim 24 wherein a ring is provided centrally within the stillage and positioned above the base, each internal partition plate having an inner end attached to said ring.

26. A stillage according to claim 25, wherein an opening is provided in the base at a position coaxial with the ring.

27. A stillage according to claim 24, wherein said partition plates comprise thin sheets of substantially flat metal.

28. A stillage for storing and/or transporting a plurality of drums containing hazardous material comprising:

a fabricated metal structure comprising a base having a substantially planar lower surface, and having a plurality of corners defining a predetermined shape of said lower surface;

a post fixedly attached to said base at each of a plurality of corners, each said post extending upwardly from and perpendicularly to the base;

a plurality of tie plates wherein each said tie plate connects, along a length of the tie plate, one of said posts to one of:

said base and another of said posts;

a support upwardly extending from said base for connecting to at least one of said tie plates at a location spaced apart from said corners, said support operably connected to a stillage component positioned within an interior defined by said tie plates for counteracting a tendency of said base to sag when a load is placed thereon;

a plurality of support pads, each of which is attached to an associated one of said posts at an end remote from the base, said support pads each having an upper planar surface substantially coincident with a predetermined plane that is parallel to said lower surface;

wherein for at least a first stillage and stacked upon a second stillage, a first said lower surface of said first stillage is supported by said plurality of support pads of said second stillage, and there is sufficient unencumbered area for contact between said first lower surface and said upper planar surface of at least one of said support pads of said second stillage so as to permit lateral movement between said first and second stillages.

* * * * *